US005222831A

United States Patent [19]

Todd, Sr. et al.

[11] Patent Number: 5,222,831

[45] Date of Patent: Jun. 29, 1993

[54] TENNIS COURT IRRIGATION

[76] Inventors: George K. Todd, Sr., 2409 Ravine Dr.; George K. Todd, Jr., 300 Manatee Dr., both of Ruskin, Fla. 33570

[21] Appl. No.: 647,098

[22] Filed: Jan. 29, 1991

[51] Int. Cl.[5] ..... E02B 13/00

[52] U.S. Cl. ..... 405/36; 405/43; 405/50; 239/557

[58] Field of Search ..... 405/36, 37, 38, 43, 405/50, 51; 403/48; 239/201, 207, 548, 557

[56] References Cited

U.S. PATENT DOCUMENTS

| | | | |
|---|---|---|---|
| 261,080 | 7/1882 | Comstock et al. | 405/39 X |
| 1,401,386 | 12/1921 | Woodberry | 405/45 |
| 1,665,104 | 4/1928 | Martienssen . | |
| 2,067,356 | 1/1937 | Swinhoe . | |
| 3,908,385 | 9/1975 | Daniel et al. | 405/37 |
| 4,180,348 | 12/1979 | Taylor | 405/43 X |
| 4,188,154 | 2/1980 | Izatt | 405/43 |
| 4,268,993 | 5/1981 | Cunningham | 405/37 X |
| 4,462,184 | 7/1984 | Cunningham | 47/58 |
| 4,576,511 | 3/1986 | Vidal | 405/37 |
| 4,832,526 | 5/1989 | Funkhouser | 405/43 |
| 4,846,604 | 7/1989 | Holtmann | 405/129 X |
| 4,881,846 | 11/1989 | Burkstaller | 405/37 |
| 4,913,596 | 4/1990 | Lambert | 405/43 |
| 4,923,329 | 5/1990 | Sparfel | 405/36 |
| 4,948,294 | 8/1990 | Mercier | 405/37 |

FOREIGN PATENT DOCUMENTS

| | | | |
|---|---|---|---|
| 111978 | 9/1964 | Czechoslovakia | 405/38 |
| 1910641 | 9/1970 | Fed. Rep. of Germany . | |
| 117327 | 6/1986 | Japan | 405/45 |
| 1198146 | 12/1985 | U.S.S.R. | 405/43 |
| 1288254 | 2/1987 | U.S.S.R. | 405/43 |
| 1377328 | 2/1988 | U.S.S.R. . | |

*Primary Examiner*—Dennis L. Taylor
*Assistant Examiner*—Arlen L. Olsen
*Attorney, Agent, or Firm*—Lowe, Price, LeBlanc & Becker

[57] ABSTRACT

An underground system for supplying water to and removing water from an athletic facility having a surface which is susceptible to excessive moisture and dryness. The system includes a plurality of substantially level watering grids which provide an arrangement of consecutive watering zones which extend across the athletic facility from one end thereof to the other. Each of the plurality of watering grids includes a plurality of parallel perforated lateral pipes which are connected at opposite ends thereof to header pipes. The plurality of substantially level watering grids are positioned at a substantially equal level below the surface of the athletic facility, regardless of the slope thereof. The system may be installed into existing athletic facilities without excessive damage or disruption to their surfaces.

12 Claims, 5 Drawing Sheets

TENNIS COURT IRRIGATION

TECHNICAL FIELD

The present invention relates to the construction, watering and drainage of athletic facilities. In particular, the present invention relates to systems and methods for watering and draining the surfaces tennis courts and lawn bowling rinks.

BACKGROUND ART

Systems located underground for supplying water to the surface or subsurface of a defined area are well known and take many forms. Such systems are utilized not only in agricultural environments for the irrigation of crops, but also in the sports and recreational fields. Such applications include underground watering systems for football and baseball fields, golf courses and in applications of hard, natural surfaced athletic facilities such as tennis courts and lawn bowling rinks which employ clay or other fast-drying playing surfaces.

Hard lawn tennis courts such as are made with sand, ashes, rubble, brick dust, clay, or the like suffer from the drawback that the upper surface layer dries very quickly and becomes too dusty. As a consequence of becoming dry and dusty, the surface becomes subjected to rapid wear so that frequent repair of the upper layer is necessary, involving considerable expense. To prevent the formation or rising of dust and subsequent surface wear and deterioration, it has, in the past, been the common practice to moisten the surface by sprinkling the surface with water.

The development of underground systems for supplying water to athletic facilities has eliminated the need for manually watering the surfaces of hard surface athletic facilities such as clay tennis courts. However, systems which have been developed heretofore have certain disadvantages in that they tend to be over-complicated and cannot be easily installed into existing athletic facilities without major disruptions to the facility. Additionally, such systems generally incorporate liners which tend to retain water, and thus cause over-watering during rain.

U.S. Pat. No. 1,665,104 to Martienssen discloses a drainage system for tennis courts which includes a plurality of inclined drain pipes located in a layer of drainage material which is intermediate a lower impermeable layer and an upper plain surface. This system is particularly designed for drainage of the playing field.

U.S. Pat. No. 2,067,356 to Swinhoe discloses a court for games which includes a plurality of parallel pipes which are connected to a water supply pipe. The pipes are located in a compartmented sub-surface layer of the playing field and are covered with a layer of broken stones and an additional layer of ashes. Excess water is drained from the field by means of gaps formed in a brick boundary which surrounds the playing field.

U.S. Pat. No. 4,576,511 to Vidal discloses an apparatus and method for creating and controlling an artificial water table. The system of Vidal includes a reservoir which controls the depth of the artificial water table. Water in the reservoir is allowed to pass through a ballast layer beneath an athletic or agricultural field and pass upwardly through a permeable membrane and into a layer of fine material by capillary action. The depth of water is controlled in the reservoir by means of a water level control float and a drain which is connected to a pump which is operated by an additional float.

U.S. Pat. No. 4,832,526 to Funkhouser discloses which includes a plurality of trenches having curved bottom surfaces with a waterproof liner located in each of the trenches. An inclined perforated pipe is located in each trench and serves to supply water to the trenches. A course material surrounds the perforated pipes and is covered by a permeable fabric material which in turn is covered by two intermediate stone aggregate layers.

Generally, prior art underground watering systems had to be installed prior to the construction of the athletic field surface area. However, the present inventor has developed an underground watering system which may be easily incorporated into existing tennis courts, lawn bowling rinks, and the like, and which may be utilized to both water and drain water from such sports facilities. This system is described in U.S. patent application Ser. No. 07/482,588, filed Feb. 21, 1990.

Existing underground watering systems have been designed without regard to the topography of the surfaces beneath which they are installed. The present inventor has discovered that topographical characteristics significantly impact the efficiency of underground watering systems.

The present invention provides for an underground watering system which is designed to be utilized in conjunction with tennis courts, lawn bowling rinks, and the like, and which do not have a level topography.

DISCLOSURE OF THE INVENTION

It is accordingly, one object of the present invention to provide an underground watering and draining system for supplying water to and removing water from the surface of a defined area regardless of the topography of the surface.

It is another object of the present invention to provide an underground watering and draining system for athletic facilities having non-level topographies.

It is yet another object of the present invention to provide an underground watering and draining system which can be installed into existing athletic facilities without major disruption of the surface thereof.

A still further object of the present invention is to provide for an underground watering and draining system which minimizes the amount of water utilized.

A still further object of the present invention is to provide a method for installing underground watering and draining systems into athletic facilities.

According to the present invention there is provided an underground system for supplying and removing moisture to and from a surface of an athletic facility which surface comprises a material which is susceptible to excessive moisture and dryness, wherein the system includes a plurality of substantially level watering grids located beneath the surface of the athletic facility, each of the plurality of substantially level watering grids including a plurality of parallel perforated lateral pipes connected at either end thereof to a pair of header pipes.

The present invention further provides for a method for installing an underground system for supplying and removing moisture to and from a surface of an athletic facility which method includes:

digging a pair of rectangularly cross sectioned trenches having substantially level bottoms in the surface of the athletic facility, the pair of trenches being parallel to one another;

digging a plurality of rectangularly cross sectioned trenches having substantially level bottoms in the surface of the athletic facility, the trenches being relatively equally spaced apart from and aligned parallel to one another and extending at opposite ends thereof between the pair of trenches;

positioning a plurality of substantially level watering grids on the bottoms of the trenches for supplying and removing moisture to and from the trenches;

filling in the trenches with a sublayer of a material through which moisture may pass by capillary action above the plurality of substantially level watering grids;

covering each of the trenches with a surface layer of the material which is susceptible to excessive moisture and dryness; and connecting the plurality of substantially level watering grids to a common water supply pipe.

BRIEF DESCRIPTION OF THE DRAWINGS

The present invention will now be described with reference to the annexed drawings, which are given by way of non-limiting examples only in which.

BEST MODE FOR CARRYING OUT THE INVENTION

Figure 1:
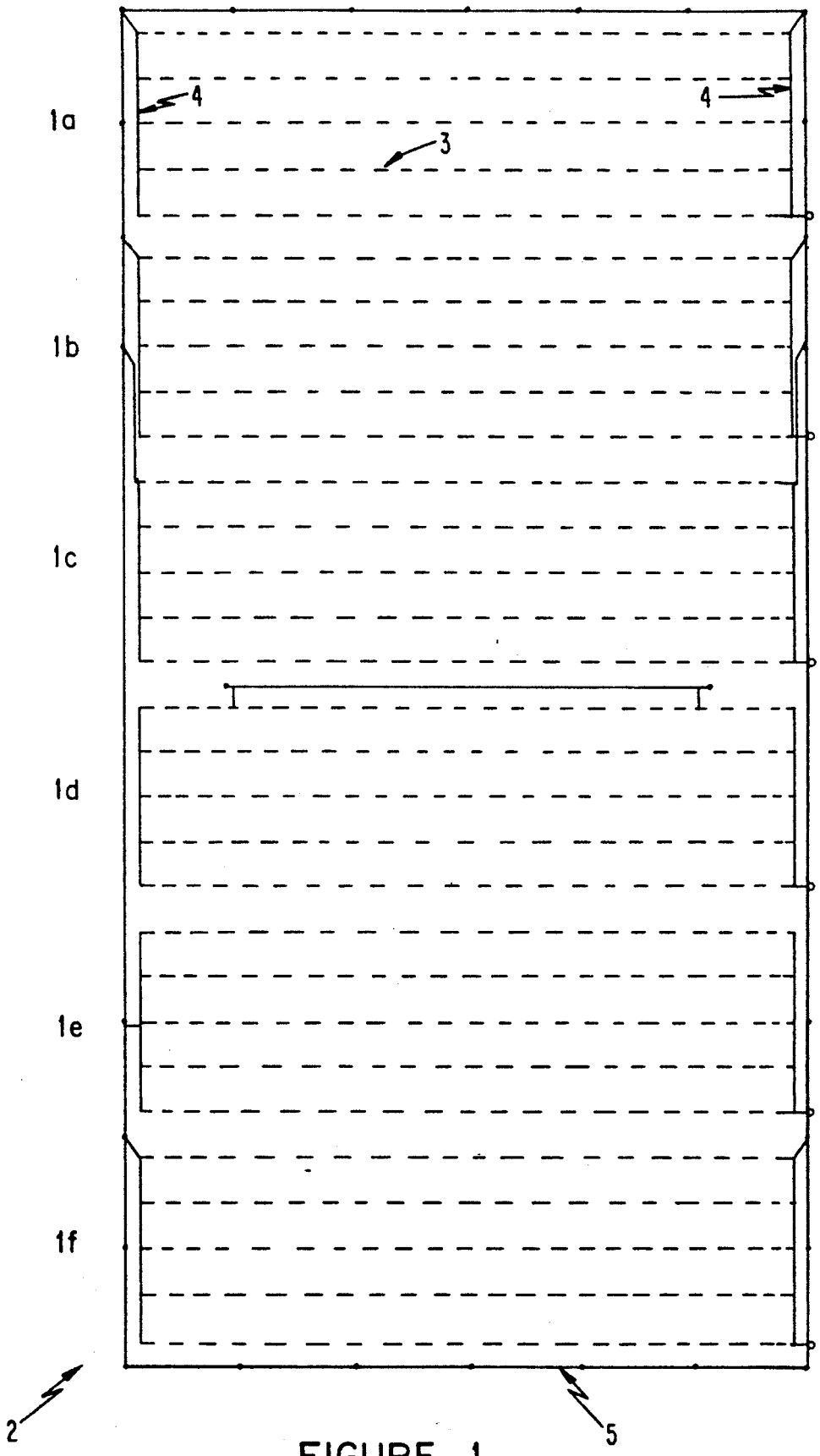
FIG. 1 is a schematic planar representation of the base of an athletic facility illustrating the arrangement of a plurality of level watering grids in accordance with one preferred embodiment of the present invention.

The present invention is directed to an underground watering and draining system which can be used to supply and remove water to and from any type of land area, but which is particularly advantageous for use in hard, natural surfaced athletic facilities or fields, including clay tennis courts and lawn bowling rinks.

The present invention includes a plurality of substantially level watering grids which define a plurality of consecutive watering zones which extend across an athletic field, e.g., clay tennis court, perpendicular to the direction in which the athletic field slopes. Accordingly, as described above, the plurality of level watering grids or consecutive watering zones of the present invention generally extend one after another across the athletic field, particularly in the case of tennis courts, sloped from end to end.

Each watering grid includes an array of parallel, lateral perforated pipes positioned below the surface of the athletic field which are connected at opposite ends thereof to a pair of header pipes. In operation, water is periodically supplied to one of the header pipes of each watering grid which distributes the water throughout the entire array of pipes. Water in the array of pipes is allowed to escape through the perforations in the pipes and diffuse through the subsurface by capillary action to supply moisture to the surface of the athletic field. The array of pipes also functions to drain and remove water from the athletic field in instances, such as during or after rainstorms, when the surface of the athletic field becomes too wet.

Water is supplied to one of the header pipes in each of the plurality of level grids by means of a common water supply pipe which is connected to a suitable source of water. A controllable valve such as a timed valve or solenoid valve operates to supply water to the water supply pipe as often as necessary to water the athletic field.

The system of the present invention is particularly novel in that the plurality of level watering grids are provided so that water is evenly distributed over the entire area of the athletic field regardless of topography of the surface thereof. Because each watering grid is level, water supplied thereto distributes evenly in the respective watering zone. When water is supplied to each level watering grid, the entire area of the athletic field is evenly watered. This allows for the use of a minimum amount of water which may be supplied at ambient pressure. The system of the present invention has been found to utilize as little as one-third of the amount of water utilized by most known non-lined prior art system.

The system is designed to either supply water to or drain water from the uppermost surface area of the athletic facility above the watering grids. This is accomplished in part by positioning the lateral perforated pipes a suitable distance apart, e.g., 2–9 feet, in trenches which are filled in by a suitable material through which water may pass by capillary action, such as compacted soil. The surface of the athletic facility such as the clay surface of a tennis court can be properly moistened by supplying water to the watering grids and removing water therefrom as often as necessary. As water enters the water supply pipe, it flows out to one of the header pipes in each of the plurality of level watering grids and through each of the parallelly aligned lateral perforated pipes. Water exits through the perforations in the pipes and seeps upwardly through the soil to reach the upper surface of the athletic facility or field. The area which is watered by each watering grid defines the watering zone associated with the respective grid.

The necessary flow required for supplying water and drainage of water through the pipe network necessarily requires that the pipes of each of the plurality of watering grids be substantially level within the respective watering grid. In installing the pipe network, it has been found particularly advantageous to use laser leveling means. Other suitable leveling means which may be employed include liquid level tubes and similar devices.

Since the present system only requires a relatively narrow trench for each parallel pipe, the system may be easily installed into existing athletic fields without causing extensive damage to the athletic facility. Only parallel, spaced apart, narrow trenches need to be dug in the surface of the athletic facility to install the present system.

Surface water such as standing water from rain showers may be effectively removed from the athletic facility by allowing the water to pass through the subsurface and enter the perforated pipes and flow therethrough out through the water drain pipe.

The present invention will now be described with reference to FIG. 1 which illustrates the array of pipes, including the arrangement of the plurality of level watering grids 1*a*–1*f* in accordance with one embodiment of the present invention. As illustrated in FIG. 1 the plurality of level watering grids provide an arrangement of consecutive watering zones which extend across the athletic facility 2 from one side thereof to the other. Each of the plurality of watering grids includes a plurality of perforated lateral pipes 3 which are connected at opposite ends thereof to header pipes 4 which are not perforated.

The array of pipes including the parallel perforated lateral and header pipes of each level watering grid are positioned beneath the surface of an athletic facility such as a tennis court having an outer border indicated generally at 5. Water is supplied to each of the individual level watering grids by a common water supply pipe 6 illustrated in FIG. 3. Likewise, water may be drained from the athletic facility if necessary by a common drain pipe 7 which is connected to each of the individual level watering grids via the float control cannister housing 20.

Figure 6:
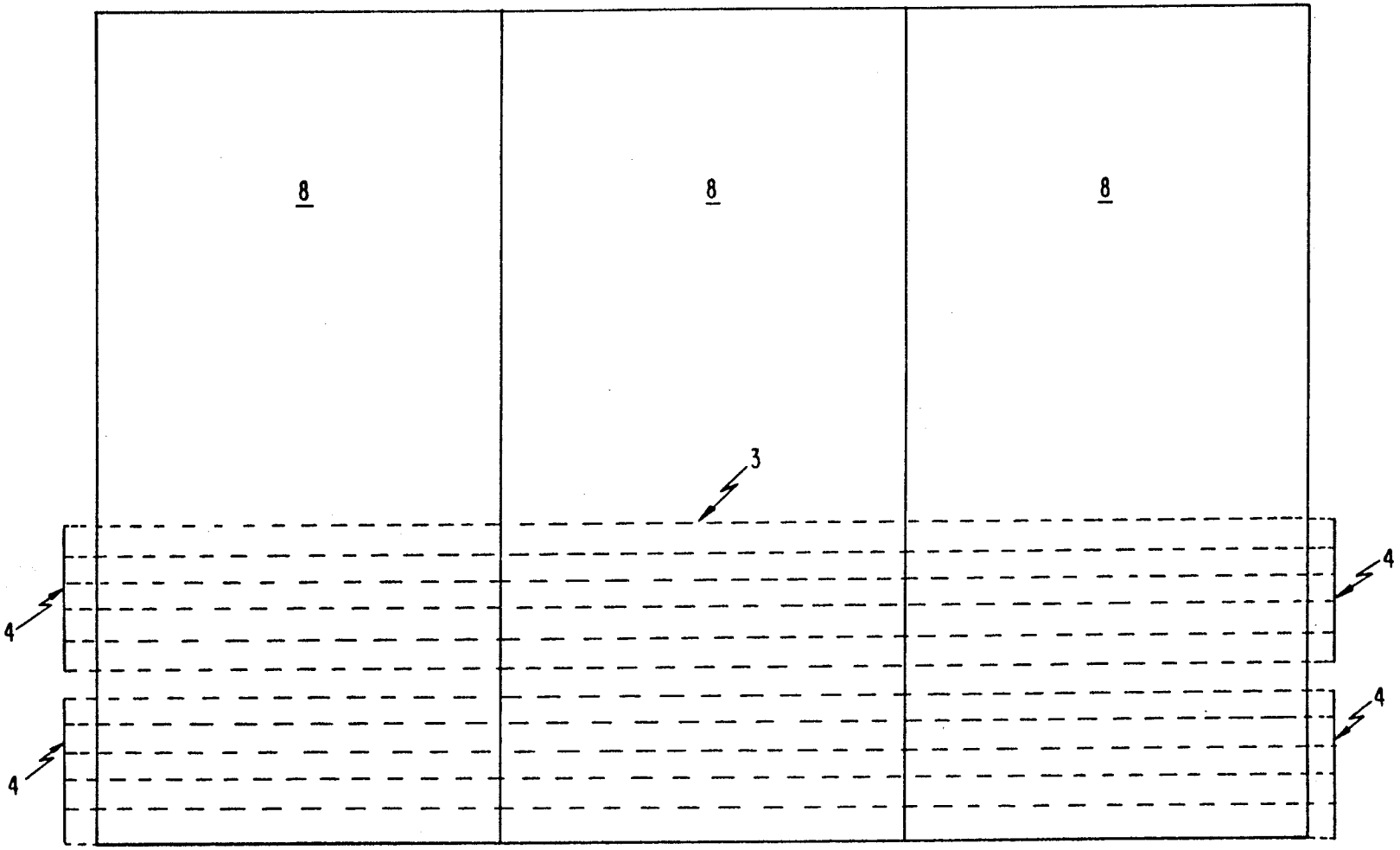
FIG. 6 is a schematic planar representation of an arrangement of a plurality of level watering grids in a multiple field/court facility.

In a preferred arrangement, the header pipes 4 are located within the vicinity or just beyond the peripheral boundary of the actual playing area of the athletic facility, e.g., within the court area of a tennis court. With the header pipes 4 positioned near the peripheral boundary of the playing area of the athletic facility, the plurality of perforated lateral pipes 3 extend across the playing area, below the surface. As illustrated in FIG. 6, in athletic facilities having a plurality of adjacent playing areas, e.g., adjacent tennis courts, a single set of opposed header pipes 4 can positioned so that two or more adjacent playing areas 8 are located therebetween. In this embodiment, the plurality of perforated lateral pipes 3 extend across each of the adjacent playing areas between the header pipes 4 below the surface.

The parallel perforated lateral pipes 3 should be evenly and sufficiently spaced apart so as to water and drain the entire area of the playing field. It has been determined that pipes positioned about 2–9 feet apart generally provide sufficient coverage for most fields. However, it should be obvious that the pipes may be positioned closer together, even though positioning the pipes closer together would require additional pipes, more expense and would necessarily require more excavating of the surface of an existing tennis court, or the like. In one embodiment illustrated in FIG. 1, a total of 6 watering grids 1*a*–1*f*, each having 5 parallel perforated lateral pipes 3 were in cooperated lengthwise under a standard 60′×120′ tennis court, wherein the perforated lateral pipes were spaced about 4 feet apart.

As can be appreciated, the number of watering grids required is dependent upon the slope of the athletic playing field. In this regard, the preferred restraints determined according to the present invention are that each of the plurality of parallel perforated lateral pipes 3 be about 3–6 inches and preferably about 4 inches below the surface, and that the maximum difference in depth between adjacent watering grids be no more than about 1.5 inches, and preferably no more than about 0.75 inches. As discussed above, the plurality of parallel perforated lateral pipes within each watering grid are substantially level with respect to one another.

The outside diameter of the parallel perforated lateral pipes should be between about 2 and about 4 inches. In a preferred embodiment, the parallel perforated lateral pipes used had a outside diameter of about 2 inches. The header pipes should also have an outside diameter between about 2 inches and about 4 inches. In a preferred embodiment, header pipes having a outside diameter of about 2 inches was found to be suitable for purposes of the present invention. In this preferred embodiment which utilized 2 inch pipes a water supply pressure of about 50–60 psi resulted in a water flow rate of about 25 gallons per minute to the entire system.

Suitable perforations in the plurality of parallel lateral pipes may include small through-holes or slits of any shape or combination of shapes. In a preferred embodiment the perforations included through-holes in the pipes having a diameter of about 0.5 inches and spaced about 4 inches apart. Suitable arrangements and sizes of the perforations are considered as being easily determined based on desired period of time in which to water or drain the athletic facility.

Figure 2:
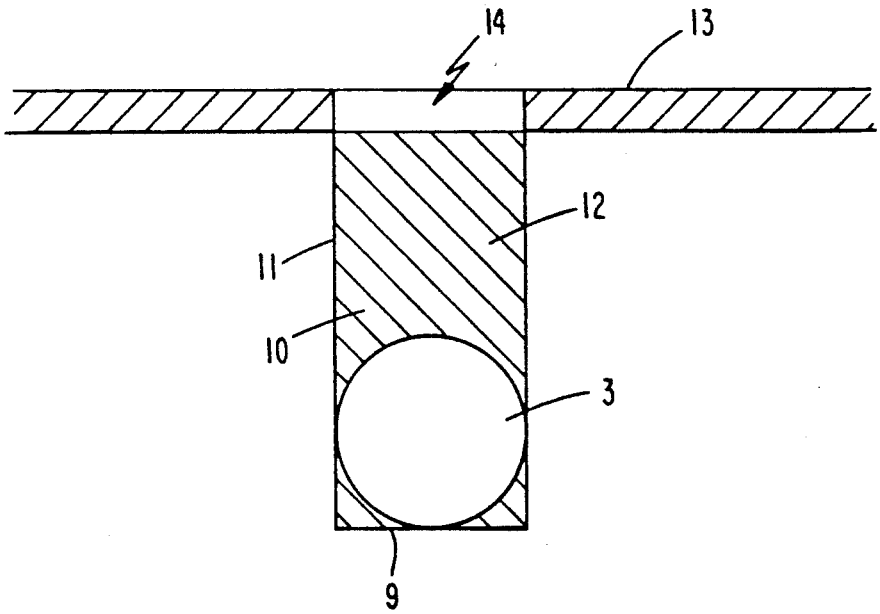
FIG. 2 is a partial schematic cross-sectional view illustrating the positioning of a perforated lateral pipe according to a preferred embodiment of the present invention.

FIG. 2 schematically illustrates an end view of one trench in which a perforated lateral pipe 3 is positioned. As illustrated in FIG. 2, the perforated lateral pipe 3 rests on the bottom 9 of trench 10. The sides 11 of the trench 9 form a rectangular cavity which is completely blocked, at its bottom portion by pipe 3. Compacted soil 12, or a similar water porous material, is placed on top of the pipe and fills the trench up to a level even with the subsurface, below the surface layer 13. On top of the compacted soil a fresh surface layer 14 such as a clay surfacing material is added to match the surrounding surface of the athletic field. The compacted soil 12 or similar material may be conditioned as necessary with other filling material such as small gravel or sand, or the like, to provide desired capillary action as well as the additional benefit of drainage. The existing clay court surface 13 is left undisturbed.

It is essential that the perforated lateral pipes 3 rest on a level bottom trench and are level with respect to one another within the individual watering grids. In this regard, it has been found particularly advantageous to check the level of the bottom of the trenches by means of a laser leveling device, or level tube, or similar device before installing the pipes. The depth of the trenches should be sufficient so that the upper surfaces of the parallel pipes are about 4 inches below the surface. Similar trenches and filling materials are utilized with the header pipes.

Because the present invention utilizes the perforated pipes to both water and drain the athletic field, and because the present invention supplies and removes water under atmospheric or ambient pressures, it is necessary for the system to have all of the perforated parallel pipes of each watering grid substantially level to one another.

Figure 3:
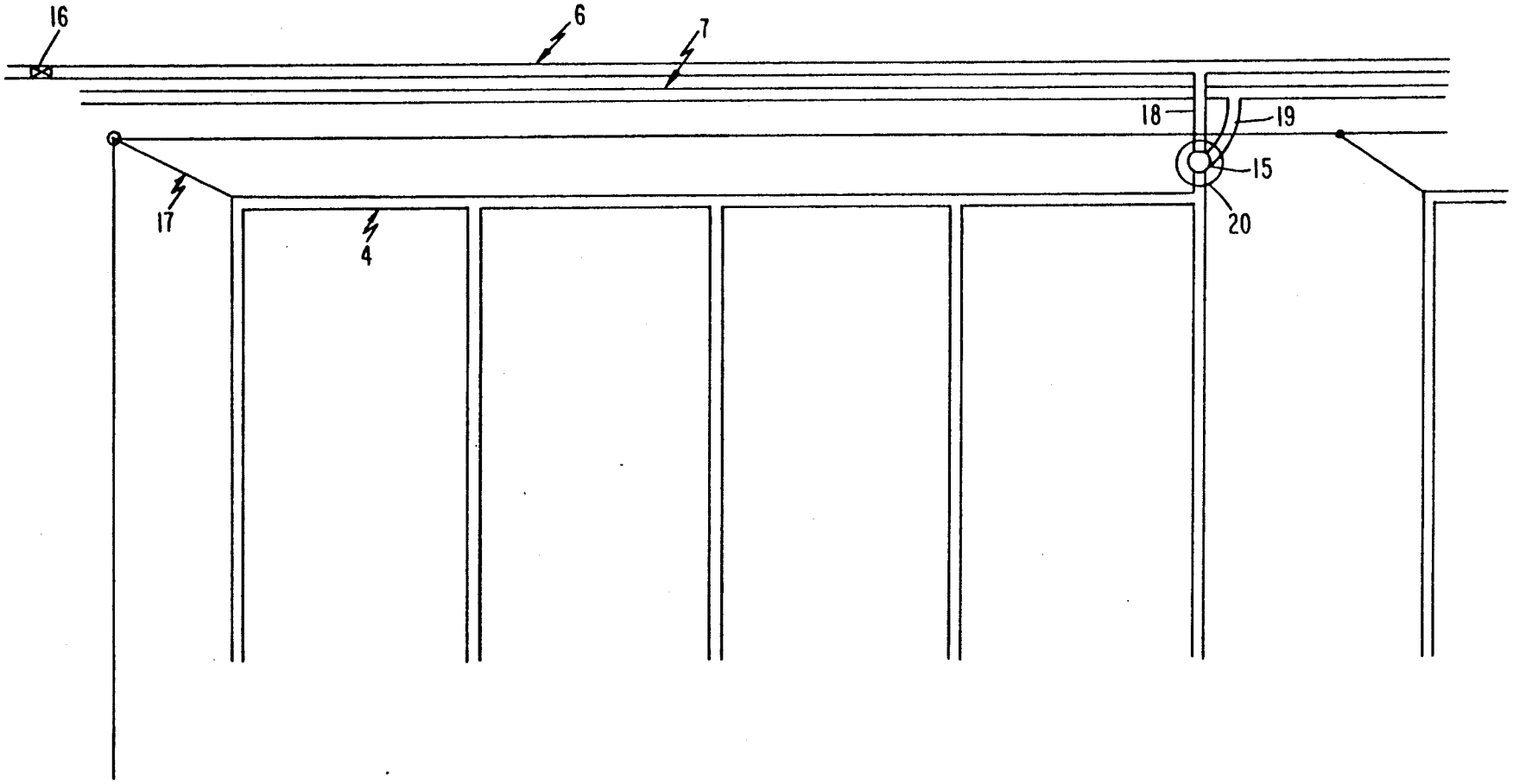
FIG. 3 is a schematic planar representation of one of the plurality of level watering grids illustrated in FIG. 1.

FIG. 3 is a schematic planar representation of one of the plurality of level watering grids illustrated in FIG. 1. As illustrated in FIG. 3, each watering grid 1*a*–1*f* is supplied with water by a common water supply pipe 6, which extends parallel to the header pipes 4. The common water supply pipe 6 is connected to each watering grid by means of a conventional float valve 15 which opens when water is being supplied to the respective watering grid. The float valve 15 closes when the respective watering grid is full of water so that only a necessary amount of water required to fill the watering grids is supplied to the system. As illustrated, the common water supply pipe 6 is connected to a suitable source or supply of water through a suitable control valve, such as a solenoid controlled valve 16.

As illustrated in FIG. 3, optional vents 17 may be included for each of the watering grids. Although not illustrated in FIG. 3, a common drain pipe 7, discussed above and below, is provided on the same side of the athletic field as the common water supply pipe 6.

Figure 4:
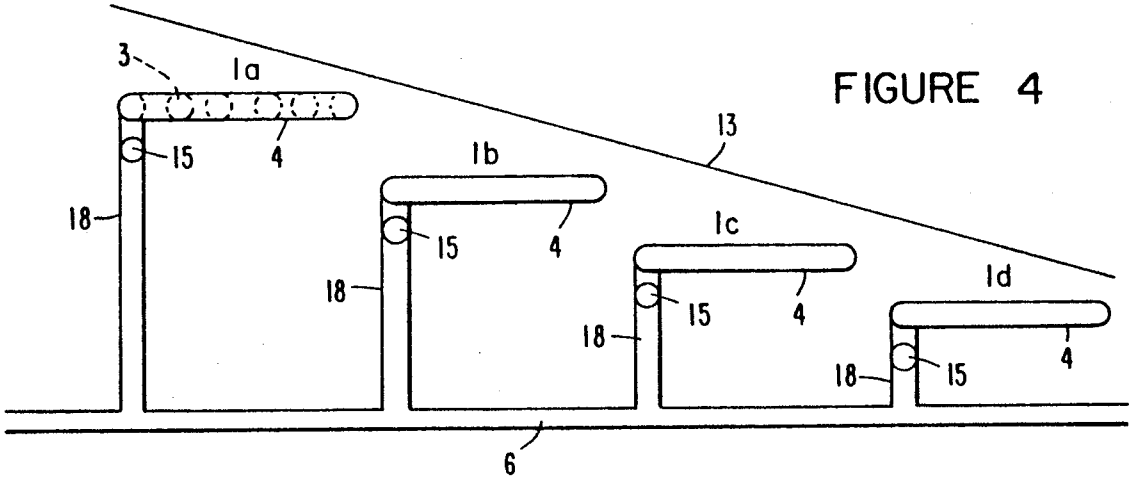
FIG. 4 is a schematic cross-sectional illustration of FIG. 1 showing the arrangement of the water supply pipe.

FIG. 4 is a schematic cross-sectional illustration of the water control system of FIG. 1 illustrating the arrangement of the water supply pipe. As illustrated in FIG. 4, the watering grids, which are illustrated so that the header pipes 4 of each watering grid are seen, are arranged so that adjacent watering grids are progressively lower than one another in the direction at which the surface 13 level slopes downwardly in order to satisfy the preferred restraints discussed above. The water supply pipe 6, is connected to a header of each of the watering grids 1*a*–1*f* by means of water supply connecting pipes 18 which have a suitable length to reach each watering grid. As discussed above, a float valve 15 is provided between the common water supply pipe 6 and each watering grid so that water may flow from the float valve to each of the water grids under the influence of gravity at ambient pressure. These float valves are located between the water supply connecting pipes and the common water supply pipe 6.

Figure 5:
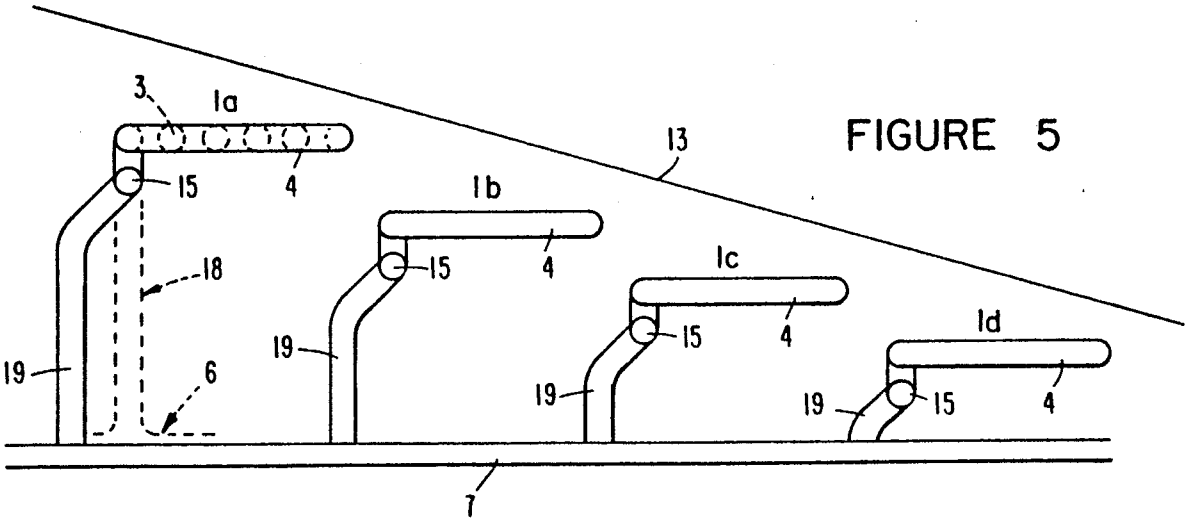
FIG. 5 is a schematic cross-sectional illustration of FIG. 1 showing the arrangement of the water drain pipe.

FIG. 5 is a schematic cross-sectional illustration of the water control system of FIG. 1 illustrating the arrangement of the water drain pipe. As illustrated in FIG. 5, the watering grids, which are illustrated in so that header pipes 4 of each watering grid are seen, are arranged so that adjacent watering grids are progressively lower than one another in the direction at which the surface level 13 slopes downwardly in order to satisfy the restraints discussed above. A common drain pipe 7 is connected to each of the watering grids by means of a drain connector pipe 19. As illustrated, the common drain pipe is located below the each of the watering grids so that water can drain from each of the watering grids under the force of gravity at ambient pressures. In order to control the draining of each watering grid individually, a stand pipe or control valve 15 is located in each of the float valve canister housings, or otherwise between the common drain pipe 7 and each drain connector pipe 19. The relative position of the water supply and a water supply connecting pipe is illustrated in phantom lines in FIG. 5.

FIG. 6 is a schematic planar representation of an arrangement of a plurality of level watering grids in a multiple field/court facility. As discussed above, FIG. 6 illustrates an embodiment wherein individual watering grids extend across a plurality of adjacent tennis courts 8.

In order to automate and prevent excess moisture in the system during rain storms, a rain cut off switch operably connected to two solenoids, one on the water supply pipe and one on a lower portion of the drain pipe, may be included which close the water supply pipe and open a lower portion of the drain pipe. Additionally, a moisture level sensor positioned to measure the moisture in the upper 2–3 inches of the playing surface could be incorporated and used to control the solenoid on the water supply pipe.

In normal operation, when the system is utilized for irrigation, intermittent waterings are preferably utilized. For example, dependent on ambient conditions, a timer may operate to open the control valve in the common water supply pipe 6 as needed for a period of time sufficient to supply each of the watering grids with sufficient water to maintain an optimum playing surface.

In an alternate embodiment, wherein the system of the present invention is installed during the construction of an athletic facility, a water-proof barrier, e.g., plastic sheet, may be installed below the arrangement of pipes to contain moisture.

The plurality of parallel perforated lateral pipes allow water to flow freely into or out of the subsurface zone that is directly below the athletic field, e.g., tennis court playing surface. Water is periodically allowed to flow into the array of pipes.

When a watering cycle ends, no additional water is supplied to the array of pipes until the next watering cycle and only water remaining in the array of pipes will be available for absorption into the subsurface zone to maintain optimum moisture. Each watering cycle is followed by a "use" cycle during which the athletic facility looses water by evaporation. If very little evaporation occurs, the subsurface zone will remain basically unchanged. Irrigation by the present invention has been found to be even, uniform and capable of maintaining constant moisture while avoiding the type of surface erosion associated with surface sprinkling methods.

One advantage of the present invention over the prior art was that water left in the array of pipes is conserved within the system. It has also been found that the present system allows use of clay tennis courts, and the like, while they are being irrigated.

The present invention requires excavation of a relatively small area of a standard tennis court surface area. Thus, the present invention may be easily installed into existing courts without major destruction of the playing surface.

Although the invention has been described with reference to particular means, materials and embodiments, from the foregoing description, one skilled in the art can easily ascertain the essential characteristics of the present invention and various changes and modifications may be made to adopt the various uses and conditions thereof without departing from the spirit and scope of the present invention as described by the claims that follow.

We claim:

1. An underground system for supplying and removing moisture to and from a surface of a clay tennis court or lawn bowling rink which slopes from end to end, which surface comprises a material which is susceptible to excessive moisture and dryness, comprising: a plurality of substantially level substantially adjacent watering grids located beneath the surface of said clay tennis court or lawn bowling rink, and perpendicular to the direction in which the tennis court or lawn bowling rink slopes, each of said plurality of substantial level watering grids comprising a plurality of parallel perforated lateral pipes connected at either end thereof to a pair of header pipes, wherein adjacent ones of said plurality of substantially level watering grids are not level with respect to one another.

2. An underground system for supplying and removing moisture to and from a surface of an athletic facility according to claim 1, further including a common water supply pipe connected to each of said plurality of watering grids.

3. An underground system for supplying and removing moisture to and from a surface of an athletic facility according to claim 2, wherein said common water supply pipe is substantially level.

4. An underground system for supplying and removing moisture to and from a surface of an athletic facility according to claim 1, further including a common drain pipe connected to each of said plurality of watering grids.

5. An underground system for supplying and removing moisture to and from a surface of an athletic facility according to claim 1, wherein said athletic facility consists of a plurality of adjacent tennis courts.

6. An underground system for supplying and removing moisture to and from a surface of an athletic facility according to claim 1, wherein said plurality of parallel perforated lateral pipes are positioned in rectangularly cross sectioned trenches having a sublayer of material through which moisture may pass by capillary action located in said each of said trenches above said parallel of parallel perforated lateral pipes.

7. An underground system for supplying and removing moisture to and from a surface of an athletic facility according to claim 6, wherein said sublayer material comprises compacted earth.

8. A method for installing an underground system for supplying and removing moisture to and from a surface of a clay tennis court or lawn bowling rink which slopes from end to end which comprises:

digging a plurality of parallel pairs of rectangularly cross sectioned trenches having substantially level bottoms in said surface of said tennis court or lawn bowling rink;

digging a plurality of rectangularly cross sectioned trenches having substantially level bottoms in said surface of said tennis court or lawn bowling rink, said trenches being relatively equally spaced apart from and aligned parallel to one another and extending at opposite ends thereof between said pairs of parallel trenches;

positioning a plurality of substantially level watering grids on said bottoms of said trenches for supplying and removing moisture to and from said trenches, said grids being positioned perpendicular to the direction in which the tennis court or lawn bowling rink slopes, wherein adjacent ones of said plurality of substantially level watering grids are not level with respect to one another;

filling in said trenches with a sublayer of a material through which moisture may pass by capillary action above said plurality of substantially level watering grids;

covering each of said trenches with a surface layer of said material which is susceptible to excessive moisture and dryness; and connecting said plurality of substantially level watering grids to a common water supply pipe.

9. A method for installing an underground system for supplying and removing moisture to and from a surface of an athletic facility according to claim 8, wherein said bottoms of each of said trenches is essentially leveled prior to positioning said plurality of substantially level watering grids therein.

10. A method for installing an underground system for supplying and removing moisture to and from a surface of an athletic facility according to claim 8, wherein each of said plurality of substantially level watering grids include a plurality of parallel perforated lateral pipes connected at either end thereof to a pair of header pipes and the cross sectional width of each of said parallel trenches is about equal to the outside diameter of said plurality of parallel perforated lateral pipes.

11. A method for installing an underground system for supplying and removing moisture to and from a surface of an athletic facility according to claim 8, wherein said sublayer comprises compacted earth.

12. A method for installing an underground system for supplying and removing moisture to and from a surface of an athletic facility according to claim 8, wherein said athletic facility consists of a plurality of adjacent tennis courts.

* * * * *